United States Patent [19]

Bernhardt

[11] 4,265,451

[45] May 5, 1981

[54] GOLF PUTTER

[76] Inventor: Floyd V. Bernhardt, 5532 N. High School Rd., Indianapolis, Ind. 46254

[21] Appl. No.: 35,613

[22] Filed: May 3, 1979

[51] Int. Cl.[3] ..... A63B 53/04

[52] U.S. Cl. ..... 273/167 G; 273/164; 273/167 F

[58] Field of Search ..... 273/77 R, 78, 80 C, 273/164, 167–175, 183 D; D21/214, 217–219

[56] References Cited

U.S. PATENT DOCUMENTS

| | | | |
|---|---|---|---|
| D. 191,211 | 8/1961 | Forest | 273/164 X |
| D. 207,227 | 3/1967 | Solheim | D21/217 |
| D. 208,414 | 8/1967 | Reuter | D21/217 |
| D. 213,507 | 3/1969 | Koenig | 273/167 G X |
| D. 223,031 | 2/1972 | Ernst | 273/80 C X |
| D. 225,118 | 11/1972 | Susilovich | D21/217 |
| D. 230,292 | 2/1974 | Gall | D21/219 |
| D. 235,568 | 6/1975 | Cook | 273/78 X |
| D. 235,893 | 7/1975 | Becker | 273/164 X |
| D. 239,402 | 3/1976 | Kindred | 273/167 G X |
| D. 246,329 | 11/1977 | Little | 273/164 X |
| 1,250,296 | 12/1917 | Fitzjohn et al. | 273/167 G |
| 1,652,404 | 12/1927 | Graveure | 273/164 |
| 3,037,770 | 6/1962 | Palmer | 273/164 X |
| 3,064,975 | 11/1962 | Smith | 273/167 G X |
| 3,077,350 | 2/1963 | Koorland | 273/164 |
| 3,085,804 | 4/1963 | Pieper | 273/168 |
| 3,219,348 | 11/1965 | Dishner | 273/80 C X |
| 3,448,981 | 6/1969 | Anweiler | 273/80 C |
| 3,497,220 | 2/1970 | Scott | 273/80 C X |
| 3,758,115 | 9/1973 | Hoglund | 273/164 |
| 3,876,211 | 4/1975 | Caligiuri | 273/164 X |
| 3,967,826 | 7/1976 | Judice | 273/80 C X |

FOREIGN PATENT DOCUMENTS

| | | | |
|---|---|---|---|
| 558183 | 1/1975 | Switzerland | 273/80 C |
| 465652 | 5/1937 | United Kingdom | 273/80 C |
| 1232651 | 5/1971 | United Kingdom | 273/80 C |

*Primary Examiner*—Richard J. Apley

*Attorney, Agent, or Firm*—Woodard, Weikart, Emhardt & Naughton

[57] ABSTRACT

A golf putter for putting a golf ball includes a clubhead having a ball-striking surface, a neck member, and a straight shaft having a grip portion at its proximal end and connecting to the neck member at its distal end. The neck member provides the connecting link between the distal end of the shaft and the top surface of the clubhead and includes a wedge-shaped portion which extends forward of the ball-striking surface. The wedge-shaped portion is segmented into an upper reduced-thickness section and a lower section which is approximately twice the thickness of the upper section. A ledge is created by this difference in thickness and is disposed coincident with the plane of interface between the upper and lower sections. A sighting line groove is located across the top surface of the ledge.

12 Claims, 7 Drawing Figures

GOLF PUTTER

BACKGROUND OF THE INVENTION

This invention relates in general to golf putters and in particular to such putters which are arranged with weighting forward of the ball-striking surface.

Golf putters represent a field of art which has received many innovations, some of which are scientifically well founded, others of which may be considered more psychological. However, whether the innovations are beneficial to one's game because they are scientifically sound or because the golfer's confidence is enhanced, the value of a golf putter is often measured by results. While this generally depicts the proper picture, innovations which are scientifically sound are still preferred over purely psychological innovations because scientific innovations are more universally applicable to a wide range of golfers, whether or not the golfer actually realizes that scientific principles are at work assisting him in his game. For example, a golf putter which is scientifically balanced to help produce a true pendulum swing is an advantage regardless of the golfer's particular style or preference or awareness of such a factor. With this general picture in mind, the following listed patents provide a sampling of various golf putter designs which have been conceived.

| | U.S. Pat. No. | Patentee | Issue Date |
|---|---|---|---|
| | 3,758,115 | Hoglund | 9/11/73 |
| | 3,448,981 | Anweiler | 6/10/69 |
| Des. | 223,031 | Ernst | 2/29/72 |
| | 3,085,804 | Pieper | 4/16/63 |
| Des. | 213,507 | Koenig | 3/11/69 |
| | 1,250,296 | Fitzjohn et al. | 12/18/17 |
| Des. | 246,329 | Little | 11/08/77 |
| | 3,064,975 | Smith | 11/20/62 |
| Des. | 235,568 | Cook | 6/24/75 |

Also to be included with this listing of conceived designs is the disclosure of "The Arrowhead" which appeared in the Jan. 4, 1972 issue of *Golf World*.

Hoglund discloses a golf putter in which there is an enlarged elongated body and a transverse planar head which are connected together by a narrow neck portion. The weight of the putter is balanced between the front and rear of the shaft connection as well as laterally of the shaft connection and the shaft is connected to the top surface of the golf putter substantially near the center of gravity of the putter.

Anweiler discloses a golf club which includes a shaft, a head and a shank portion. The head has a dimension measured rearwardly of and perpendicular to the striking surface, which is less than the horizontally disposed dimension between the opposite boundary of the striking surface when the head is in a ball-striking position.

Ernst discloses a golf putter head in which the shaft is connected to the club head by means of a triangular neck portion which is open internally. The configuration of this neck portion is such that one side of the triangle connects between one end of the clubhead and the shaft, another side of the triangle connects between the opposite end of the clubhead and the shaft and the third side of the triangle is provided by the top surface of the clubhead itself.

Pieper discloses a golf putter wherein the head is configured with a long, uniform, straight-sided top surface divided into two slightly divergent planes intersecting each other substantially centrally of the length thereof in a line at right angles to the length of the putter. The ball-striking side faces of the putter are planform and symmetrical and converge slightly toward the lower edge of the clubhead in order to provide a negative loft and produce slight overspin on a golf ball when struck by the golf putter.

Koenig discloses a golf putter head in which the club shaft is secured to the top surface of a rearwardly protruding portion behind the ball-striking surface of the clubhead. The rearwardly protruding portion is straight-sided, although tapered, and is centrally disposed between the upper and lower surfaces of the clubhead as well as the outermost ends of the clubhead.

Fitzjohn et al. discloses a golf club in which the neck portion is integral with the rear of the clubhead and curves rearwardly and upwardly therefrom with a particular curvature style. A stated object of this invention is to establish a particular relationship between the head and the handle of the golf club such that when the club is held in a striking position, the head will automatically be balanced or will adjust itself into a proper position for striking the ball squarely.

Little discloses a golf putter head in which the neck portion connecting the clubhead to the shaft is secured to the clubhead at one corner of its upper surface and extends forward and upward from this point of connection. The ball-striking surface is provided with a mesh-like series of grooves and the rear portion of the clubhead is completely hollow, enclosed only by a relatively thin portion of the top surface of the clubhead and an equally thin bottom portion which extends upwardly as it extends rearwardly from the ball-striking surface.

Smith discloses a golf club putter whose lower surface and general contour are arranged to provide a nonscuff putter. The putter includes a flat ball-striking blade which is supported by a nonscuff shoe and the latter holds the blade in an elevated position so that the bottom of the blade is spaced above the bottom of the shoe. This arrangement spaces the blade bottom above the playing surface on which the golf ball rests when the shoe bottom contacts with the playing surface.

Cook discloses a golf putter head design which is slotted in a variety of different arrangements, although the overall configuration is that of a conventional golf putter.

The "Arrowhead" golf putter includes an arrangement which provides center shafting, back shafting and a rocker bottom in order to help prevent scuffing against the green. The center shafting feature provides a certain degree of static weight balance between the inside and outside edges of the clubhead. The back shafting is intended to produce more overspin.

One very definite aspect of each of these designs, with the exception of Anweiler, is that the clubhead surface which contacts the golf ball is the forwardmost surface of the club. Thus, the mass of the clubhead which helps provide driving momentum to the golf ball is disposed behind this ball-striking surface. Similarly, with each disclosed design, while the clubhead may take on a variety of shapes and styles, the neck portion which connects the clubhead to the shaft is typically a tube-like member. This is true for the listed references including the Anweiler patent as well as for all other putters of which the inventor is aware. Although the neck portion may be variously bent in order to connect between its point of attachment to the clubhead and the distal end of the shaft, it commonly has a generally circular lateral cross section. The neck portion of the mentioned golf putter designs is only used as a connecting link between the clubhead and the shaft and does not provide any other benefits or improvements to the golf putter, either scientific in nature or psychological in nature.

If a golf putter could be designed to utilize the neck portion for purposes other than merely a point-to-point connection, then various-styled putters could be improved without the necessity to alter the basic concepts embodied in the clubhead design. This would enable golfers who have a preferred clubhead style to retain this style yet achieve added benefits by only a modification to the neck portion. Consider, for example, the addition of weight to the neck portion so that the club-to-ball transfer of momentum can be increased without having to modify clubhead design or increase the speed of the stroke. By selectively shaping this added weight, it can be arranged as a forward-pointing protuberance, possibly wedge or arrowhead shaped, which can serve as an alignment aid as well as provide greater overall balance to the golf club. Furthermore, by positioning this added weight, or at least a majority of it, forward of the ball-striking surface of the clubhead, the clubhead is pulled as well as pushed through the stroke thereby reducing the chances of a mis-hit or twisting of the clubhead.

It would also be an improvement to golf putter designs to configure the clubhead in such a manner that virtually the full surface area of the ball-striking surface would be suitable for a true and accurate shot yet provide a different "feel" depending on the point of impact. For example, by contouring or recessing the rear surface of the clubhead at various locations, the ball-striking surface produces different "feels" to the golfer depending on where the golf ball meets the ball-striking surface, and thus the golfer is able to select the particular point of impact which best suits his golfing (putting) preferences.

The golf putter invention disclosed herein is provided with such a forward-weighted neck portion and with such clubhead balance and contouring in order to achieve the mentioned advantages as well as other advantages which will become apparent from the descriptions which follow.

SUMMARY OF THE INVENTION

A golf putter for putting a golf ball along a path of desired golf ball travel according to one embodiment of the present invention comprises a shaft member having a grip portion adjacent a first end and a primary longitudinal axis; a clubhead having a rear surface, a ball-striking surface, a sole portion between the rear surface and the ball-striking surface and a top surface between the rear surface and the ball-striking surface; and a neck member joined to and extending between the shaft member and the clubhead, the neck member having a wedge-shaped portion extending forward of the ball-striking surface and pointed in the direction of desired golf ball travel.

One object of the present invention is to provide an improved golf putter.

Related objects and advantages of the present invention will be apparent from the following description.

DESCRIPTION OF THE PREFERRED EMBODIMENT

Figure 1:
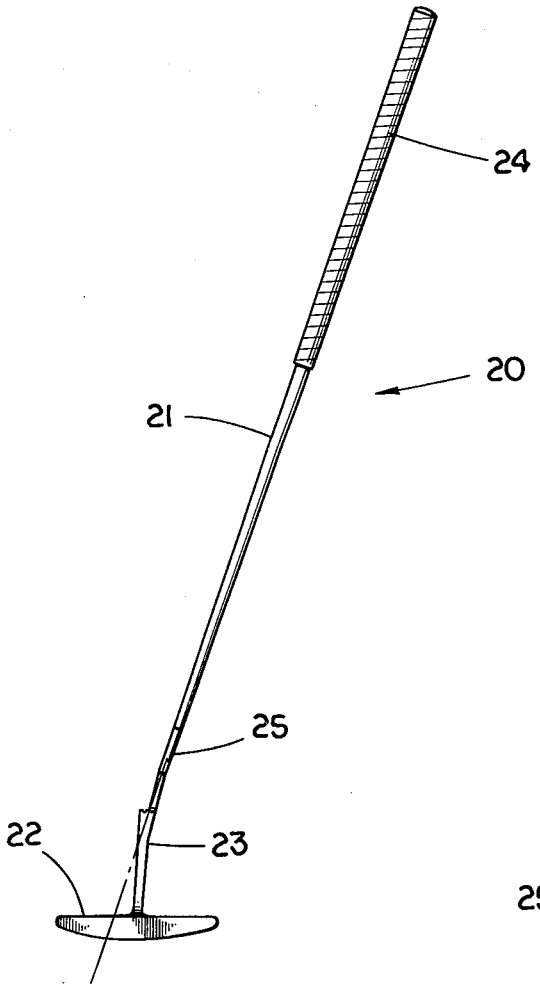
FIG. 1 is a front elevation view of a golf putter according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is illustrated golf putter 20 which includes a shaft member 21, a clubhead 22 and a substantially planar neck member 23 connecting shaft member 21 and clubhead 22 together. Shaft member 21 includes a gripping portion 24 adjacent one end and a sleeve fitting 25 adjacent the opposite end. Sleeve fitting 25 is generally tubular in design although slightly tapered and secures shaft member 21 to neck member 23. Alternatively it is envisioned that shaft member 21, neck member 23 and clubhead 22 could all be fabricated from a single integral piece of metal or similar material and thus it is not required that the various component parts which make up golf putter 20 be fabricated as individual parts and then assembled.

However, conventional golf club construction dictates that normally the clubhead 22 and neck member 23 are joined together at the fabrication stage such as by a casting or forging operation and the particular shaft member 21 is then secured to the uppermost end of the neck member 23. The desirability in attaching the shaft member as a separate component part is that this member is typically constructed of a different material than the clubhead and neck member and is fabricated in a different manner. There is also a secondary advantage to this separate construction concept and that is that the shaft member may be varied as to its stiffness and length while the clubhead and neck member remain the same. As will become apparent hereinafter, it is envisioned as part of the concepts associated with the present golf putter invention that the neck member 23 could be fabricated as a replaceable item such that it would be separately joined to the clubhead and to the shaft member rather than be cast or forged as part of the clubhead. This replaceable or interchangeable concept enables the neck member characteristics to be revised without the necessity to change the shaft member or the clubhead configuration.

Figure 2:
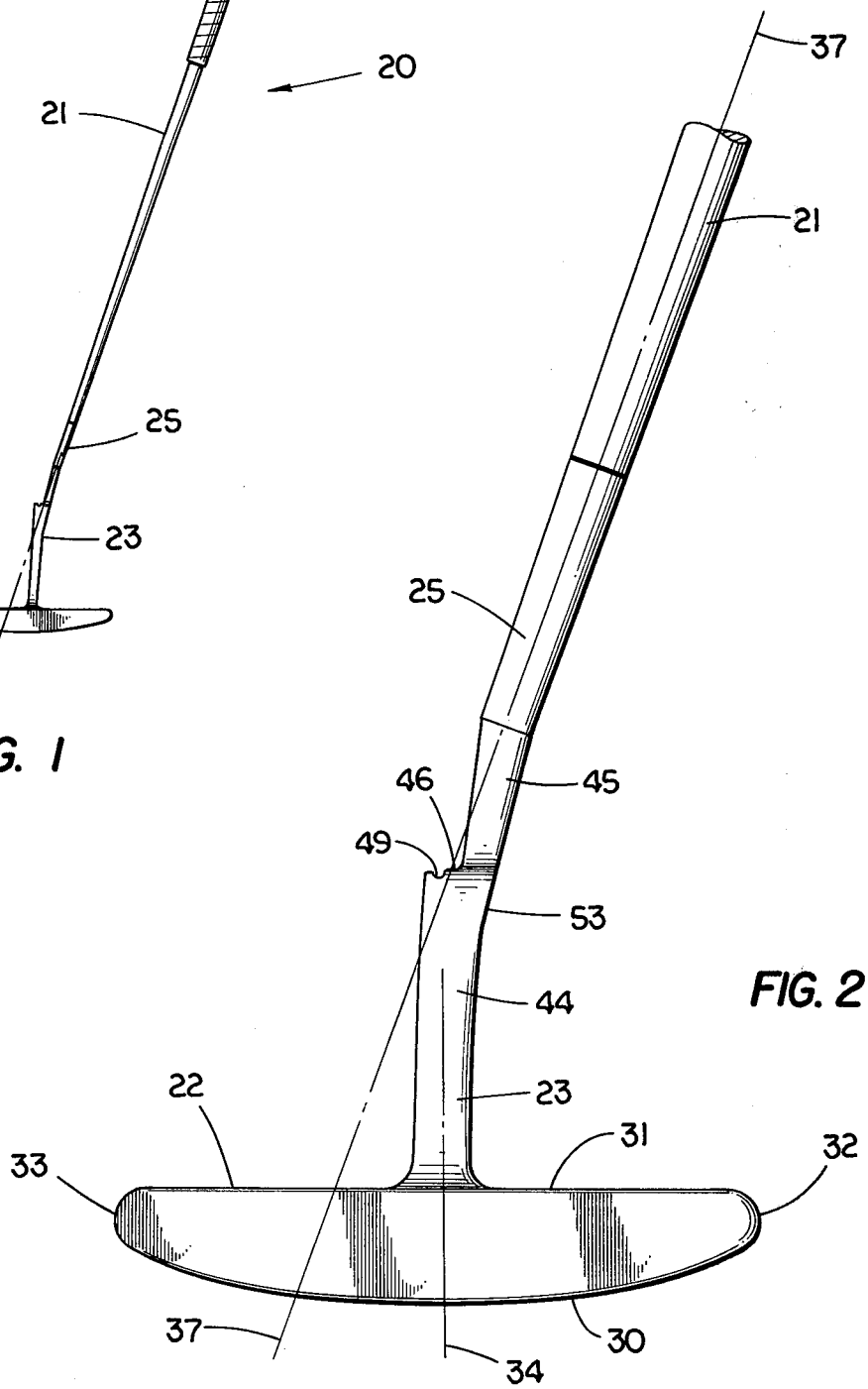
FIG. 2 is a partial front elevation view, enlarged over the FIG. 1 illustration, of the clubhead and neck member of the FIG. 1 golf putter.
Figure 4:
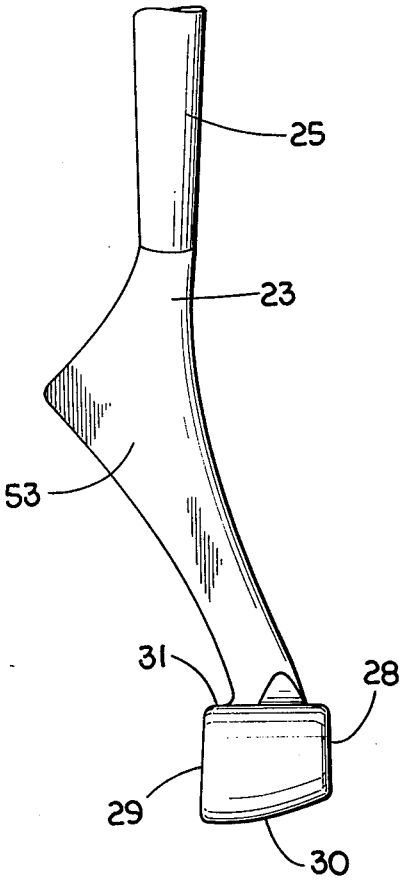
FIG. 4 is a partial side elevation view of the FIG. 2 golf putter as viewed from the right side of FIG. 2.
Figure 3:
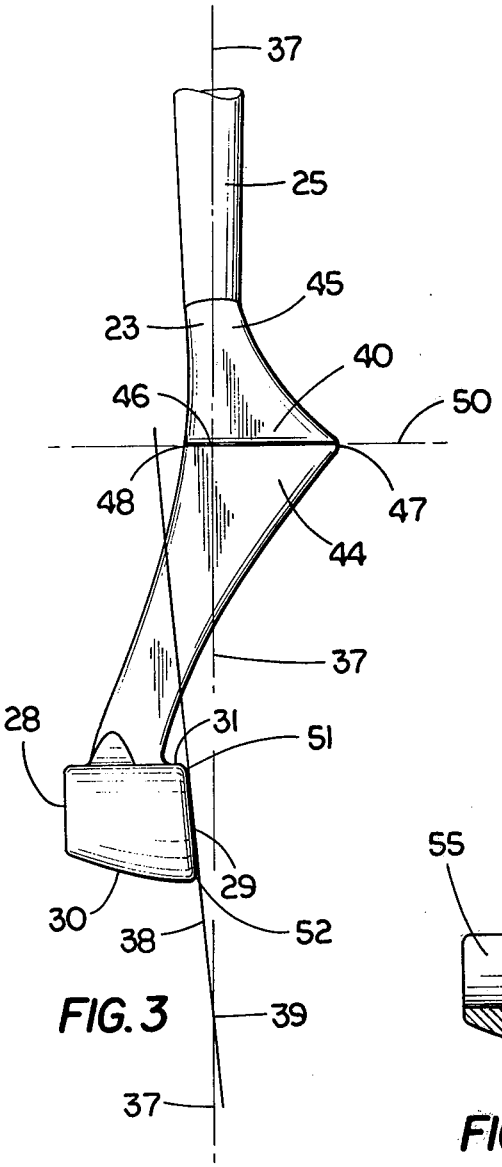
FIG. 3 is a partial side elevation view of the FIG. 2 golf putter as viewed from the left side of FIG. 2.

Referring to FIGS. 2, 3 and 4, the clubhead 22 and neck member 23 will be described and discussed in greater detail. Clubhead 22 includes a rear surface 28, a ball-striking surface 29, a sole portion 30 having a compound curvature and extending between rear surface 28 and ball-striking surface 29 and a substantially flat top surface 31 also extending between rear surface 28 and ball-striking surface 29. It is to be understood that golf putter 20 is arranged for a right-handed golfer in that shaft member 21 extends at an incline from its point of connection with neck member 23 toward the area where a golfer would stand. Therefore, inner end 32 is that end of clubhead 22 which is closest to the golfer and outer end 33 of clubhead 22 is that end which is farthest from the golfer. The compound curvature to sole portion can best be illustrated by first referring to FIG. 2 wherein sole portion 30 upwardly and outwardly diverges from centerline 34 toward inner end 32 and outer end 33. The second curvature of sole portion 30 is the upward and rearward curvature between the lower edge of ball-striking surface 29 and the lower edge of rear surface 28.

Shaft member 21 is generally cylindrical throughout, although slightly tapering, and has a primary longitudinal axis which is coincident with and represented by line 37. Ball-striking surface 29 is substantially flat and is disposed in a ball-striking geometric plane represented by line 38 in FIG. 3. Ball-striking surface 29 is inclined in an upward and rearward manner to provide approximately 3 degrees of positive loft. The relationship between the primary longitudinal axis line 37 and the ball-striking geometric plane 38 is best illustrated in FIG. 3. As can be seen from this figure, line 37 extends forward of ball-striking surface 29 and the intersection of ball-striking geometric plane 38 and primary longitudinal axis line 37 is a point 39 which is clearly, although slightly, below the common edge of ball-striking surface 29 and sole portion 30. Primary longitudinal axis line 37, although extending forward of ball-striking surface 29, passes across surface 29, in a projected sense (see FIG. 2), between inner end 32 and outer end 33 and in fact is approximately midway between outer end 33 and centerline 34.

Reference to line 37 being forward of ball-striking surface 29 is based upon the concept that the forward direction is the direction of desired golf ball travel and it is ball-striking surface 29 which contacts the golf ball in order to direct it along this desired path of travel. A further relationship between primary longitudinal axis line 37 and clubhead 22 is illustrated in FIG. 2 in which it is illustrated that line 37 while not intersecting clubhead 22, does in fact extend past clubhead 22 entirely on one side of centerline 34. This particular geometric and positional relationship between shaft member 21 (line 37) and clubhead 22 results in a golf putter design which may be referred to as an "offset" golf putter. The concept of "offset" is that the shaft member does not couple directly to nor does its primary longitudinal axis intersect the clubhead at any point. Thus, it is the neck member which must be oriented, contoured or bent in such a manner so as to bridge the separation between the lowermost end of the shaft member 21 and the top surface 31 or rear surface 38 of the clubhead and connect the shaft member 21 to the clubhead 22.

While such "offset" golf putters are preferred by many golfers, there is one very definite disadvantage or drawback to the overall design and configuration. This drawback involves the previously mentioned relationship in which primary longitudinal axis line 37 extends forward of ball-striking surface 29. This particular arrangement places all of the clubhead weight behind this primary longitudinal axis line and affects the overall balance of the golf putter. With conventional designs, if there is any portion of the golf putter which extends forward of this primary longitudinal axis line, it would be the neck member. However, virtually every neck member of every putter is a conventional tubular neck member which is bent or contoured solely for the purpose of making the connection between the clubhead and the end of the shaft member. The present design provides an improvement over conventional golf putters and compensates to a very great degree the disadvantage and drawback of rear-weighted, offset golf putters. This compensation is provided for by neck member 23 in that it includes a wedge-shaped portion 40 which extends forward of ball-striking surface 29 and is pointed in the direction of desired golf ball travel (forward direction). A significant amount of wedge-shaped portion 40 is forward of primary longitudinal axis line 37 and acts as a weight compensation to clubhead 22 and improves the overall balance of the clubhead.

While the wedge-shaped appearance of neck member 23 provides a very unique concept to golf putter designs, there is yet another feature of neck member 23 which is also quite unique. A review of the FIG. 2 illustration indicates that neck member 23 includes a lower portion 44, an upper portion 45 and a ledge 46 located coincident with the interface plane between lower portion 44 and upper portion 45. Ledge 46 is substantially flat and extends the full width of wedge-shaped portion 40 between forwardmost protruding point 47 and rear point 48. Protruding point 47 is triangular in shape and substantially planar. Ledge 46 while extending across the full surface of portion 40 is also disposed entirely forward of ball-striking geometric plane 38 (see FIG. 3). Furthermore, ledge 46 includes groove 49 disposed therein which also extends the full width of wedge-shaped portion 40. Line 50 is coincident with the longitudinal axis of groove 49 and groove 49 serves as a sighting line for the golfer.

Inasmuch as one important aspect of a putting stroke is that the clubface be square with the ball upon impact, the use of groove 49 as a sighting line is an advantage in that it (line 50) is perpendicular to the top edge line 51 which is common to ball-striking surface 29 and top portion 31. Line 50 is also perpendicular to bottom edge line 52. Thus, the golfer is able to visualize a right-angle relationship between groove 49 and either or both top edge line 51 and bottom edge line 52 as the golfer looks down toward the ground with a resultant view similar to that provided in FIG. 5. In this manner, the golfer is able to utilize groove 49 both as a sighting line and as a double-check on the squareness of the ball-striking surface. The general geometry of groove 49 and its relationship to lower portion 44 and upper portion 45 results in a situation wherein lower portion 44 is approximately twice the thickness (see FIG. 2) of upper portion 45. In this manner surface 53 is common to both portions and is both smooth and continuous as is illustrated in FIGS. 2 and 4. Thus, it is the opposite side of wedge-shaped portion 40 which is modified in order to provide ledge 46 in the manner shown.

Figure 7:
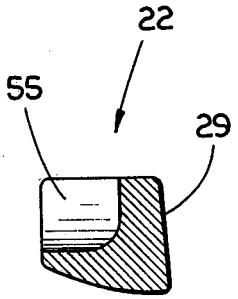
FIG. 7 is a side elevation section view of the clubhead of the FIG. 2 golf putter as taken along line 7—7 in FIG. 6.
Figure 5:
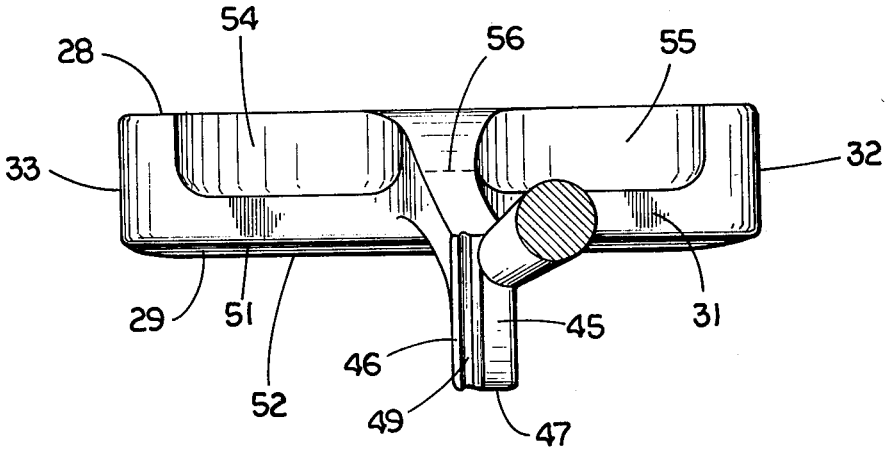
FIG. 5 is a partial top plan view of the FIG. 2 golf putter.
Figure 6:
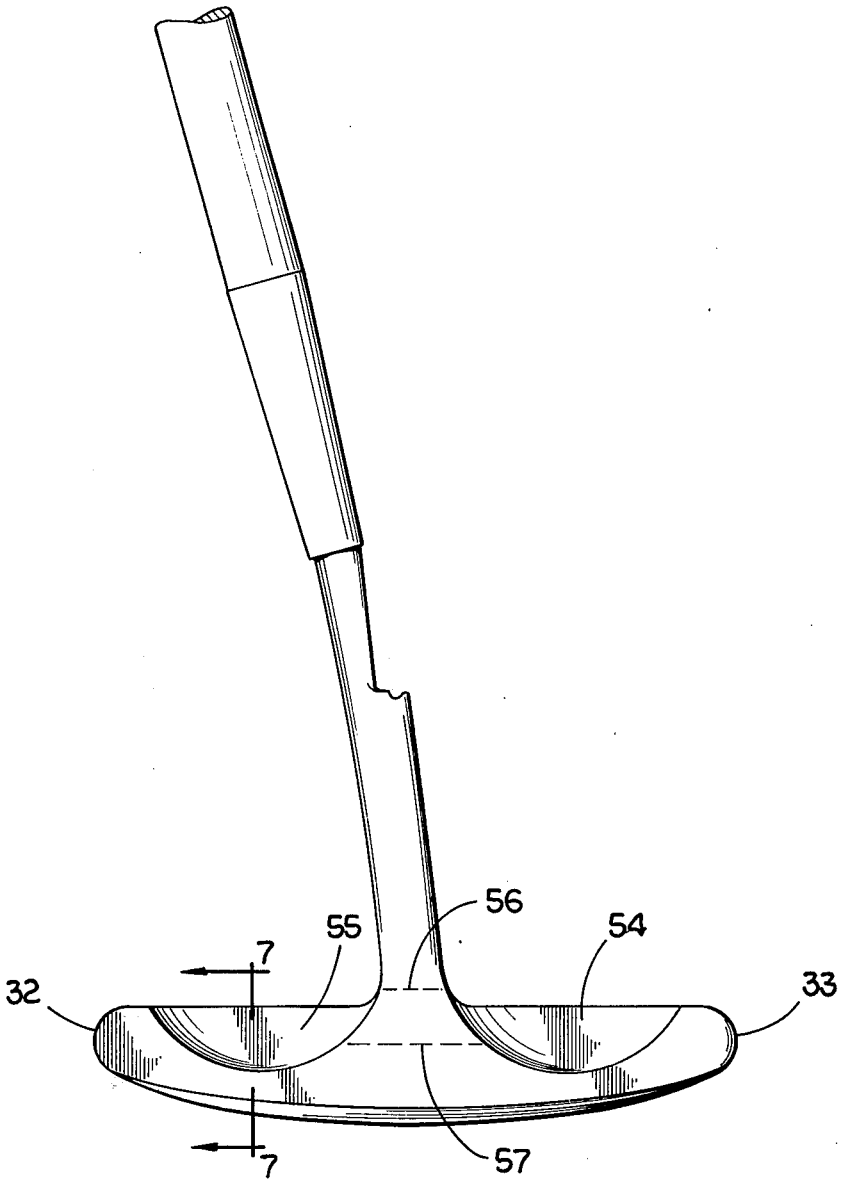
FIG. 6 is a partial rear elevation view of the FIG. 2 golf putter.

Up to this point in the description of this invention, reference has been made generally to rear surface 28, and although under conventional golf putter designs, the rear surface is normally continuous in nature being either flat or slightly curved, rear surface 28 disclosed herein has a pair of recesses 54 and 55 which are generally part-cylindrical depressions in configuration (see FIGS. 5, 6 and 7). Recess 54 is located between outer end 33 and the point of attachment of neck member 23 to clubhead 22 and recess 55 is oppositely disposed between inner end 32 and the point of attachment of neck member to the clubhead. The amount of material removed from clubhead 22 in order to create recesses 54 and 55 may be varied and thereby vary the overall size of these recesses. However, it is preferred to limit the amount of material removed such that the entire area of ball-striking surface 29 remains suitable for impact with a golf ball and is neither so heavy nor so light that shots are adversely influenced. While a majority of the clubhead and neck member weight is disposed about centerline 34, the presence of recesses 54 and 55 provide a location for golf ball impact which provides to the golfer a softer and lighter feel. Nevertheless, the forward weighting to the club provided by wedge-shaped portion 40 and the other aspects of neck member 23 and clubhead 22 still produce overroll or topspin to the golf ball upon impact and follow-through. Thus, if a golfer desires a slightly softer or lighter feel, all that need be done is to position the golf ball at or near a location on the ball-striking surface 29 which corresponds to or is aligned with one of the two recesses. By retaining a significant portion of weight adjacent outer end 33 and inner end 32, the overall weight of the clubhead is not reduced to the point that it would be unacceptable and virtually any point of impact across the entire area of ball-striking surface 29 produces a suitable stroke with sufficient momentum and topspin imparted in order to have a well-guided accurate putt.

As has been previously mentioned, neck member 23 may be joined as a single integral part of clubhead 22 such as by a casting or forging operation. Alternatively, as has also been discussed, neck member 23 may be a separate part joined to the clubhead by a subsequent assembly operation such as by welding, brazing, bolting or cementing. However, regardless of the method of attachment or joining of neck member 23 to clubhead 22, the point of attachment may be either at top surface 31 or rear surface 28 or a combination of the two. The pictorial arrangements of FIGS. 2, 3 and 4 suggest that neck member 23 is joined to top surface 31. However, the arrangement of FIGS. 5 and 6 suggest that neck member 23 is joined to both top surface 31 and rear surface 28. The reason that neck member 23 appears to be attached in part to rear surface 28 is that clubhead 22 and neck member 23 are illustrated as a single integral piece which has been either cast or forged and thus there is neither a line of separation nor a parting line tending to identify which portion corresponds to neck member 23 and which portion constitutes clubhead 22. Broken line 56 represents one possible the interface between clubhead 22 and neck member 23 and the location of broken line 56 corresponds to that particular arrangement in which neck member 23 is joined to top surface 21 of clubhead 22. Alternatively, the line of interface between neck member 23 and clubhead 22 may be represented by broken line 57 and the location of broken line 57 would correspond to that situation in which the neck member is joined to rear surface 28. The important point to note is that either location is acceptable as well as a combination of the two or a variety of alternative points of connection and configurations so long as the general concepts disclosed herein and improvements provided by this particular invention are preserved by the particular neck member concept disclosed.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An offset-style golf putter for putting a golf ball along a path of desired golf ball travel, said golf putter comprising:

a shaft member having a gripping portion adjacent a first end and a primary longitudinal axis;

a clubhead having a rear surface, a ball-striking surface, a sole portion between said rear surface and said ball-striking surface and a top surface between said rear surface and said ball-striking surface, said ball-striking surface defining and coincident with a ball-striking geometric plane; and a neck member joined to and extending between said shaft member and said clubhead, said neck member having a weight-balancing portion disposed in the direction of desired golf ball travel forward of said ball-striking surface and forward of said primary longitudinal axis, said weight-balancing portion acting as a weight compensation to the clubhead for improving the overall balance of the offset-style golf putter.

2. The golf putter of claim 1 in which said neck member initially extends upwardly in a vertical plane, said vertical plane being substantially perpendicular to said top surface of said clubhead, and said neck member being joined to the approximate center of the top surface of said clubhead.

3. The golf putter of claim 1 in which the clubhead includes two recessed depressions in said rear surface oppositely disposed on either side of said neck member.

4. The golf putter of claim 1 wherein said weight-balancing portion is generally wedge-shaped and arranged into a lower first section, an upper second section, and includes a sighting line shelf therebetween.

5. The golf putter of claim 4 wherein said upper second section has a thickness which is approximately one-half the thickness of said lower first section.

6. The golf putter of claim 5 in which said primary longitudinal axis intersects said ball-striking geometric plane at a single point, said single point being below said sole portion.

7. The golf putter of claim 1 in which the clubhead includes two recessed depressions in said rear surface, oppositely disposed on either side of said neck member, and said sole portion is shaped with a compound curve, one curve beginning at the lower edge of said ball-striking surface and extending upwardly as it extends rearwardly to to the lower edge of the rear surface.

8. The golf putter of claim 1 in which said clubhead further includes an inner end and an outer end and said primary longitudinal axis extends forward of said ball-striking surface and passes between said inner end and said outer end, said clubhead being free of any intersection with said primary longitudinal axis.

9. A golf putter for putting a golf ball along a path of desired golf ball travel, said golf putter comprising:

a shaft member having a gripping portion adjacent a first end and a primary longitudinal axis;

a clubhead having a rear surface, a ball-striking surface, a sole portion between said rear surface and said ball-striking surface and a top surface between said rear surface and said ball-striking surface, said ball-striking surface defining and coincident with a ball-striking geometric plane, said rear surface having two recessed depressions; and a neck member joined to and extending between said shaft member and said clubhead, said neck member joined to said clubhead between said two recessed depressions and including a tapered, forward protruding portion and a sighting line shelf centrally disposed as part of said forward protruding portion, said sighting line shelf being disposed entirely forward of said ball-striking geometric plane.

10. A golf putter for putting a golf ball along a path of desired golf ball travel, said golf putter comprising:

a shaft member having a gripping portion adjacent a first end and a primary longitudinal axis;

a clubhead having a rear surface, a ball-striking surface, a sole portion between said rear surface and said ball-striking surface and a top surface between said rear surface and said ball-striking surface, said ball-striking surface defining and coincident with a ball-striking geometric plane; and a substantially planar neck member joined to and extending between said shaft member and said clubhead, said neck member being arranged into two substantially planar portions including a first portion joined to the approximate center of the top surface of said clubhead and extending upwardly to a straight edge portion and forward to a substantially planar tapered point, said tapered point being disposed forward of said primary longitudinal axis, the second portion of said two portions begins at a location adjacent said straight edge portion and extends upwardly and rearwardly to a point of attachment to said shaft, said straight edge portion being coincident with the centerline of said tapered point.

11. The golf putter of claim 10 wherein said first portion is substantially thicker than said second portion, the thickness difference between said first portion and said second portion defining a shelf, said shelf being coincident with said straight edge portion.

12. The golf putter of claim 10 wherein the entire straight edge portion is positioned forward of said ball-striking geometric plane.

* * * * *